US005354213A

United States Patent [19]

Hoffman

[11] Patent Number: 5,354,213

[45] Date of Patent: Oct. 11, 1994

[54] ADJUSTABLE ELECTRICAL CORD CLAMP

[75] Inventor: Ernest G. Hoffman, Middlefield, Conn.

[73] Assignee: Hubbell Incorporated, Orange, Conn.

[21] Appl. No.: 40,993

[22] Filed: Mar. 31, 1993

[51] Int. Cl.[5] ..... H01R 13/595

[52] U.S. Cl. ..... 439/469

[58] Field of Search ..... 439/469, 813

[56] References Cited

U.S. PATENT DOCUMENTS

| | | | |
|---|---|---|---|
| 2,490,153 | 12/1949 | O'Donnell | 439/814 |
| 2,911,616 | 11/1959 | Townsend | 439/814 |
| 3,402,382 | 9/1968 | De Tar | 439/469 |
| 3,571,781 | 3/1971 | Gartland, Jr. | 439/465 |
| 3,605,059 | 9/1971 | Lipinski | 439/674 |
| 3,784,961 | 1/1974 | Gartland, Jr. | 174/156 |
| 3,856,376 | 12/1974 | Poliak et al. | 439/465 |
| 4,080,036 | 3/1978 | Hagel | 439/469 |
| 4,178,056 | 12/1979 | Lee | 439/472 |
| 4,213,667 | 7/1980 | Wittes | 439/469 |
| 4,669,806 | 6/1987 | Fuchs | 439/813 |
| 4,921,455 | 5/1990 | Marie et al. | 439/813 |
| 5,021,006 | 6/1991 | Fargeaud et al. | 439/469 |
| 5,046,961 | 9/1991 | Hoffman | 439/141 |
| 5,217,389 | 6/1993 | Mackay et al. | 439/466 |

FOREIGN PATENT DOCUMENTS

| | | | |
|---|---|---|---|
| 497811 | 8/1928 | Fed. Rep. of Germany | 439/460 |
| 2132758 | 1/1973 | Fed. Rep. of Germany | 174/153 G |
| 2801483 | 7/1979 | Fed. Rep. of Germany | 439/469 |
| 1347500 | 11/1963 | France | 439/469 |

*Primary Examiner*—Gary F. Paumen

*Attorney, Agent, or Firm*—Jerry M. Presson; Alfred N. Goodman

[57] ABSTRACT

An electrical connector and cord clamp includes a main body having an axial passage therein for receiving an electrical cord and a fixed clamping jaw extending from an upper face of the main body. A movable jaw is interconnected with the fixed clamping jaw by a plurality of screws for applying clamping forces between the fixed and movable jaws. Carried by the fixed or movable jaw, a projecting member is movable from a recessed position in which the clamp grips a standard size cord to an extended position projecting radially into the axial passage between the fixed and movable clamping jaws in which the clamp grips a small size electrical cord. The projecting member is coupled to and movable relative to the jaws via a threaded connection, a bayonet connection, or a cam and cam follower connection.

45 Claims, 5 Drawing Sheets

ADJUSTABLE ELECTRICAL CORD CLAMP

FIELD OF THE INVENTION

The present invention is directed to an apparatus for clamping an electrical cord and in particular an electrical cable. More specifically, the invention relates to a clamping arrangement in combination with an electrical connector adapted for selectively and adjustably clamping different size electrical cords.

BACKGROUND OF THE INVENTION

Electrical devices such as electrical connectors typically have an electrical cable or conductor extending from the device. It is necessary to securely fasten the electrical conductor to the electrical device to prevent the conductor from being pulled free from the device which can damage the conductor and the electrical device. In addition, pulling or tearing the electrical conductor from the electrical device can render the device inoperable and can seriously injure the operator due to the electrical current carried in the conductor. Electrical connectors and other electrical devices typically include an assembly for clamping or otherwise securing the end of the electrical conductor to the device. Electrical devices and in particular electrical connectors are primarily constructed for use with a normal range of standard size cable. However, there are instances where cables smaller than the standard size are desired or required. Thus, it is important to have an electrical connector or other device that accommodates different size electrical conductors. Many of the electrical devices currently available are not able to effectively accommodate different size electrical conductors.

Examples of such assemblies for securing a standard size electrical conductor in a connector or other electrical device are disclosed in U.S. Pat. Nos. 2,490,153 to O'donnell, 2,911,616 to Townsend and U.S. Pat. No. 3,402,382 to De Tar. These devices generally include a relatively large diameter polymeric threaded screw extending through an outer wall of the housing of the device to press the electrical conductor against the opposite side of the housing. This arrangement has the disadvantage of being limited in the extent of the translational movement of the screw and thus limited in size of the electrical conductor which can be secured. These devices are not always able to effectively grip electrical conductors of different sizes because of the lower mechanical advantage of converting rotary motion to linear clamping thrust of a large diameter screw. Furthermore, the head of the screw cannot include teeth that engage the conductor, since the rotational movement of the screw needed to apply the clamping force will damage the conductor.

Another common construction of electrical devices include a fixed clamping jaw and a movable clamping which are biased toward each other by screws or other means to grip the electrical conductor. Examples of this type of electrical device are shown in U.S. Pat. Nos. 5,046,961 to Hoffman; 3,784,961 to Gartland Jr.; U.S. Pat. No. 3,605,059 to Lipinski; and U.S. Pat. No. 3,856,376 to Poliak et al. Of these prior devices, only U.S. Pat. No. 3,784,961 to Gartland is specifically directed to a clamp assembly able to accommodate cables of different diameter. The clamp assembly disclosed in this patent includes a recess in the fixed jaw and a recess in the movable jaw to accommodate large size cables.

An insert can be inserted into the recess of the fixed jaw to reduce the dimension of the passage between the jaws so as to effectively grip the cable. Although this structure utilizing the insert effectively grips cables of different diameters, it is necessary to remove the movable jaw from the assembly to conveniently remove the insert, thereby requiring an additional step for the operator. In addition, the removal of the insert inevitably results in the insert being lost and thus precluding the subsequent clamping of a smaller cable. Since the insert may fit loosely in the clamping jaw, it also tends to become separated from the clamping jaw during shipping. Since all inserts are for the less frequently used small diameter cords, they must always be removed before clamping a standard size cable. Finally, failure to remove the insert, which is sized for the smallest cord range, when clamping a standard size cable may result in damage to the cable or the connector.

The above-noted devices demonstrate a continuing need in the art for an electrical device that is able to accommodate different size electrical conductors. There is further a need for electrical devices where the assembly for accommodating different size cables is captively retained with the main body of the device to prevent loss of components.

SUMMARY OF THE INVENTION

Accordingly, it is a primary object of this invention to produce an electrical connector and cord clamp that is able to accommodate electrical cords of different size.

Another object of this invention is to provide an electrical connector with a minimum number of moving components and with components that are captive in the connector.

Another object of this invention is to provide a connector which is received by the user with the cord clamp set for the most frequently used cord diameters.

Another object of this invention is to provide an electrical connector which has a projecting member reciprocally mounted in the connector to selectively adjust the clamping capacity of the connector.

Another object of this invention is to provide an electrical connector having a retractable projecting member in either a fixed or a movable clamping jaw for adjusting the effective size of an axial opening in the connector.

The above objects and advantages of the invention are basically attained by an electrical cord clamp comprising: a main body having an outer wall and an inner wall, said wall defining an axial passage for receiving an electrical cord; means on said inner wall defining a first clamping Jaw; a second clamping jaw opposing said first clamping jaw and being movable perpendicular to said axial passage; connecting means for interconnecting said first and second clamping jaws and for applying clamping forces to an electrical cord in said axial passage; said first clamping jaw having a radial bore therethrough extending radially with respect to said axial passage; and projecting means, disposed in said radial bore and being axially movable therein from a first position to a second position projecting radially inward from said inner wall into said axial passage for engaging said electrical cord and biasing said electrical cord against said second clamping jaw.

Other objects are attained by providing an electrical cord having a main body with an inner wall to define an axial passage for receiving an electrical cord, a plurality of electrical contacts and clamping means for clamping said electrical cord in said axial passage, said clamping means comprising: a first clamping jaw on said inner wall having a clamping face in said axial passage; a movable second clamping jaw having a clamping face opposing said first clamping jaw; connecting means for interconnecting said first and second jaws and for applying clamping forces to an electrical cord in said axial passage; and projecting means rectilinearly and rotatably movable about an axis radially disposed to said axial passage, said projecting means being movable from a first position to a second position projecting into said axial passage for selectively adjusting the cross-sectional dimension of said axial passage and clamping said electrical cord against one of said jaws.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE INVENTION

Figure 1:
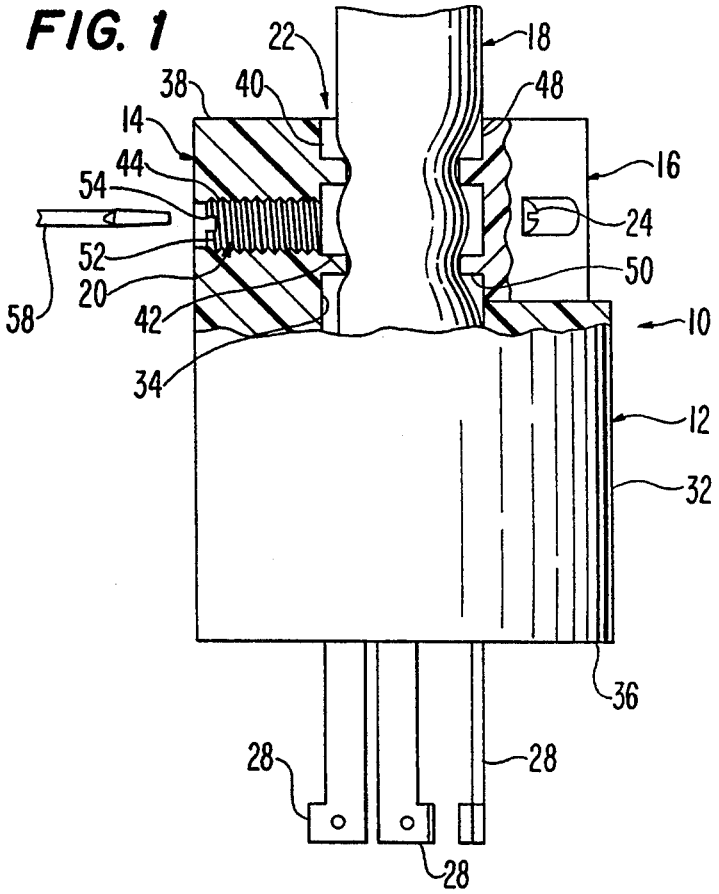
FIG. 1 is a side elevational view in partial cross section of a first embodiment of the invention showing an electrical connector having a threaded projecting member in the retracted position to accommodate a standard size electrical cord.
Figure 2:
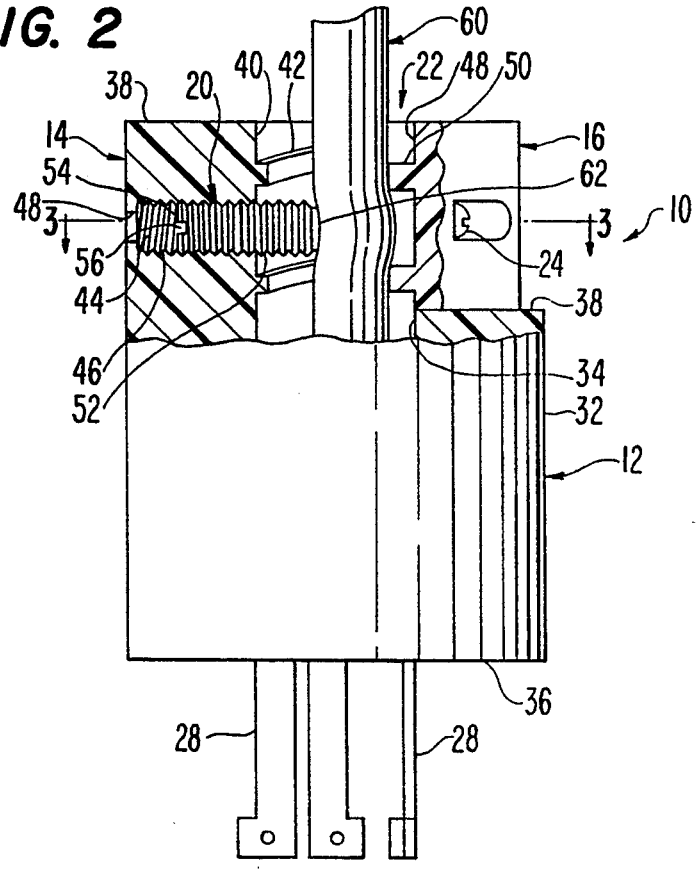
FIG. 2 is a side elevational view in partial cross section of the embodiment of FIG. 1 showing the threaded projecting member in the extended position to clamp a small diameter electrical cord.
Figure 3:
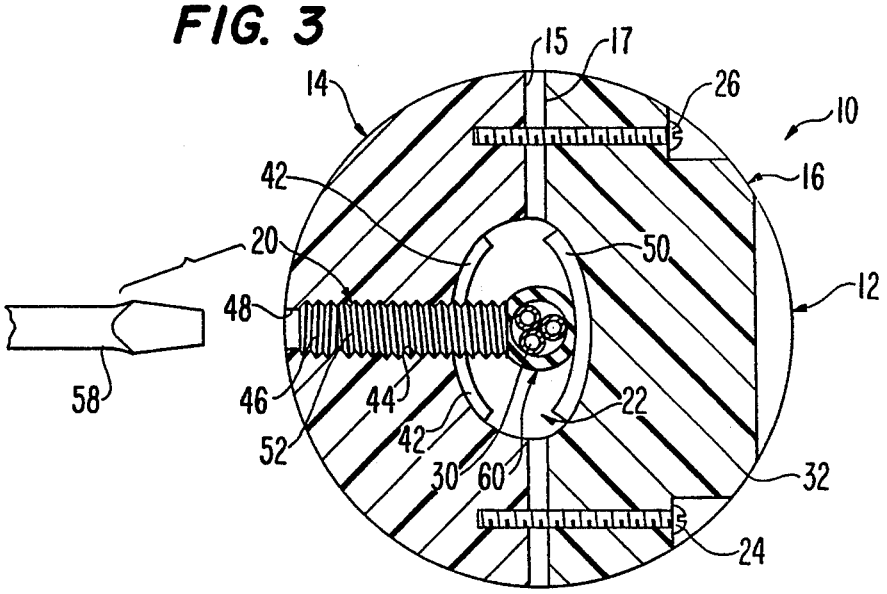
FIG. 3 is a top plan view in cross section of the embodiment of FIG. 2 taken along line 3—3 in FIG. 2.

As seen in FIGS. 1–3, the electrical cord clamp in accordance with the invention is an electrical connector 10 comprising a main body 12 having a first fixed clamping jaw 14; a second movable clamping jaw 16 for clamping a large electrical cord 18 or a small electrical cord 60; and a projecting member 20 which is mounted for translational movement into and out of an axial passage 22 extending through the main body 12. The clamping jaws 14 and 16 are connected together by a pair of screws 24 and 26 for biasing the jaws together and applying clamping or gripping pressure to the electrical cord between the clamping jaws with the cord extending through the axial passage 22.

In the embodiment of FIGS. 1–3, the electrical connector 10 is illustrated as a male electrical connector including three electrical blades or prongs 28. The male electrical connector is connected to a female receptacle by inserting the prongs into the receptacle and angularly translating the prongs therein to lock the connector and receptacle together. In alternative embodiments, the electrical connector may be a female receptacle or a coupling for providing electrical connection between two electrical cords. In preferred embodiments, the main body, clamping jaws and projecting member are made from an insulating plastic material.

The electrical cord or cable 18 includes an outer insulating sheath or covering which encloses at least one and preferably a plurality of smaller insulated conductors. Typically, three insulated conductors 30, as seen in FIG. 3, are included in the cord. The insulated conductors 30 have exposed ends for electrical connection with the prongs 28. The outer sheath of insulation on the cord is generally sufficiently flexible to allow gripping by the clamp.

The main body 12 comprises a tubular and preferably cylindrical outer wall 32 and an inner wall 34 defining the axial passage 22. The electrical prongs 28 extend from a lower end 36 of the main body while the electrical cord 18 enters the axial passage 22 from the top end 38.

The first, or fixed, clamping jaw 14 is integrally formed with the main body 12 as an extension thereof, as shown in FIGS. 1 and 2. The contoured inner wall 40 of the first clamping jaw 14 is a continuation of the inner wall 34 defining the axial passage 22. The inner wall 40 of the first clamping Jaw 14 has a pair of gripping ribs 42 raised from the surface thereof facing the axial passage. As illustrated in FIG. 2, the gripping ribs 42 are disposed in a spiral fashion with respect to the axial passage 22. The gripping ribs 42 and the inner wall 40 form the clamping surface of the jaw 14.

A radial bore 44 having internal threads 46 extends radially through the first clamping Jaw 14 from the outer wall to the contoured inner face 40 of the jaw 14. In preferred embodiments, the bore 44 is positioned between the two raised gripping ribs 42. A stop member 48, shown as an inwardly extending annular rib, is positioned adjacent the outer wall of the first clamping jaw 14 at the axial end of the bore.

The second clamping Jaw 16 is separable from the main body 12 and is movable in a radial direction with respect to the axial passage 22 by the threaded screws 24 and 26. The movable jaw 16 includes a contoured inner surface 48 which cooperates with the contoured inner surface 40 of the first clamping jaw 16 to establish a conduit of variable size for receiving the electrical conductor 18 as shown in FIG. 1. Raised gripping ribs 50 are disposed on the contoured surface 48 of the movable Jaw 16 for engaging the electrical cord 18. The raised gripping ribs in the embodiment shown are arranged in a spiral manner with respect to the axial passage and are oriented to criss-cross relative to the gripping ribs 42 on the fixed jaw 14. In alternative embodiments, the raised gripping ribs are arranged orthogonal to the axial passage. The contoured inner wall of movable jaw 16 and the raised gripping ribs 50 form the clamping surface of the movable jaw to cooperate with the fixed jaw 14. As shown in FIG. 3, the screws 24, 26 are threaded into threaded holes in the fixed jaw 14 to bias the jaws together. The fixed jaw and the movable jaw 16 each have flat faces 15 and 17, respectively, adjacent each contoured wall 40 and 48 which face each other to limit the inward radial movement of the movable jaw 16.

The projecting member 20 in this embodiment has an elongated cylindrical shape with continuous external threads 52 for mating with the internal threads 46 in radial bore 44. As shown in FIGS. 1–3, the projecting member 20 is received in the bore 44 for movement in a radial direction with respect to the axial passage 22. An outer axial end 54 of the projecting member 20 includes a recess 56 for receiving a rotary tool 58. In preferred embodiments, the recess 56 is a transverse slot for receiving a conventional screwdriver as shown in FIG. 1. Alternatively, the recess 56 may be shaped to receive a Phillips-type screwdriver, Allen wrench, star-type wrench, or other tool. The stop member 48 in the bore 44 limits the movement of the projecting member away from the axial passage 22. The projecting member 20 preferably has a length so that it can be completely recessed in the bore as shown in FIG. 1 and can be extended to project into the axial passage as shown in FIG. 2.

The electrical connector 10 is assembled by inserting the electrical cord 18 through the axial passage and making the necessary and conventional electrical connections to the prongs 28. The movable clamping jaw 16 is then coupled to the first clamping jaw 14 by inserting the screws 24 and 26 through the holes in the jaws. The screws are then tightened to apply clamping forces between the movable jaw and the fixed jaw 14 so that the raised gripping ribs 42 and 50 are compressed and biased against the electrical cord 18.

In FIG. 1, the standard size electrical cord 18 is positioned in the electrical cord which substantially fills the axial passage 22. The projecting member 20 is shown in FIG. 1 in the completely retracted first position so that the gripping ribs 42 on the fixed jaw 14 engage the electrical cord and the projecting member 20 does not contact the cord. As shown in FIG. 1, the raised ribs on the fixed jaw and the movable jaw form an impression in the outer casing of the electrical cord by the clamping forces.

The electrical connector 10 is adapted for receiving and efficiently gripping an electrical cord having a smaller outer diameter than the standard size electrical cord shown in FIG. 1. In preferred embodiments, the connector 10 is manufactured and shipped with the projecting member 20 in the retracted position so that the connector can be used on a standard size cord without any adjustment or alteration being required. To accommodate a smaller size electrical cord 60, as seen in FIGS. 2 and 3, the rotary tool 58 is inserted into the recess 56 to rotate the projecting member 20 causing translational and axial movement of the projecting member through the bore 44 to extend into the axial passage 22 to effectively reduce the internal diameter of the axial passage. Once the small diameter cord 60 is inserted into the axial passage 22, the screws 24 and 26 are then tightened to apply clamping forces between the movable jaw 16 and the projecting member 20 which is now extending into the axial passage. As shown in FIG. 2, the small sized electrical cord 60 is clamped between the projecting member 20 and the gripping ribs 50 of the movable jaw 16.

In the operation for clamping the small size electrical cord 60, the electrical cord may be inserted through the axial passage of the main body with the appropriate electrical connections being made to the prongs 28. The projecting member 20 is then rotated to extend into the axial passage 22 until the axial face 62 of the projecting member contacts the electrical cord 60. The movable jaw 16 is then moved toward the electrical cord by tightening the screws 24 and 26 to apply the clamping forces between the projecting member and the movable jaw. Alternatively, once the electrical cord 60 is in place in the axial passage 22, the movable jaw 16 may be first moved inwardly toward the axial passage by tightening the screws 24 and 26, followed by adjustment of the projecting member 20 until the axial face 62 of the projecting member 20 applies a sufficient clamping force against the electrical cord to secure the electrical cord 60 in the axial passage 22 of the main body 12. It is preferred to adjust the position of the projecting member first since this allows greater clamping forces to be applied by the movable jaw. Regardless of the order of steps taken, the end result is the projecting member 20 applying a localized clamping or gripping force to one side of the electrical cord and the gripping ribs 50 of the movable clamping jaw 16 applying a clamping or gripping force to the opposite side of the electrical cord. The localized clamping force provided by the projecting member in the embodiment of FIGS. 1–3 is positioned between the gripping ribs 50 on the movable jaw 16 to cause a slight compression or deformation of the walls of the cord to assist in the gripping of the cord.

Figure 4:
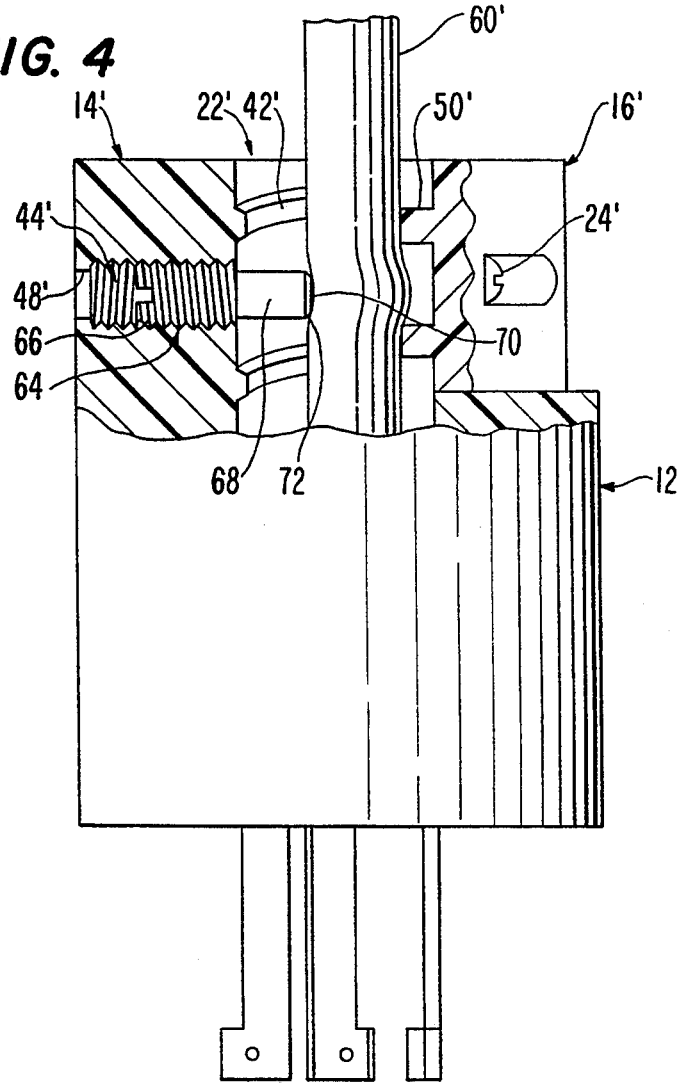
FIG. 4 is a side elevational view in partial cross section of a second embodiment showing an electrical cord having a threaded screw with an extension on an axial face thereof and being in the extended position to clamp a small diameter electrical cord.

Embodiment of FIG. 4

In a modified embodiment as illustrated in FIG. 4, the projecting member 64 comprises a substantially elongated and cylindrical shaped body having an externally threaded portion 66 complementing the threads in the bore 44' of the first clamping jaw. A cylindrical section 68 extends axially from the threaded portion of the projecting member 64. The cylindrical section 68 terminates at an axial face 70 having a frustoconical edge 72 for engaging the electrical cord. In this embodiment, the main body, first jaw and movable second jaw are substantially identical to the components of the embodiment of FIGS. 1–3. The identical components are thus identified by the same reference numeral with the addition of a prime.

The assembly and operation of the electrical connector of the embodiment of FIG. 4 is substantially the same as in the embodiment of FIGS. 1–3. The projection member 64 can be retracted into the bore 44' in the fixed clamping jaw 14' so that the axial passage 22' can accommodate a standard size electrical cord. The clamping forces are then applied by screws to bias the movable jaw toward the electrical cord and grip the cord between the gripping ribs 42' of the fixed jaw 14' and the gripping ribs 50' of the movable jaw 16'.

As shown in FIG. 4, an electrical cord 60' having a smaller outer diameter than a standard electrical cord is clamped in the connector by rotating the projecting member 64 to extend the cylindrical section 68 into the axial passage. The axial face 70 of the cylindrical section 68 engages the electrical cord to apply a localized clamping force. The screws 24' and 26' interconnecting the clamping jaws together are then tightened to move the movable jaw inwardly toward the projecting member 64 and the electrical cord to apply clamping forces to the cord. The localized clamping force applied by the projecting member causes the axial face of the projecting member to be impressed into the outer casing of the electrical cord as shown in FIG. 4. In a similar manner, the raised gripping ribs on the contoured surface of the movable jaw are impressed in the outer casing of the electrical cord.

In the embodiments of FIGS. 1–3 and FIG. 4, the electrical cord can be removed from the electrical connector by loosening the screws to move the movable clamping jaw away from the axial passage and the cord and to release the clamping forces between the first clamping jaw and the movable clamping jaw. The electrical cord can then be removed from the connector. The position of the projecting member can be selectively adjusted to accommodate a different size electrical cord. The projecting member can be retracted into the fixed clamping jaw so that the axial face of the projecting member is substantially flush with the contoured inner wall of the clamping Jaw. The annular collar in the bore of the fixed clamping jaw prevents the projecting member from being completely removed from the clamping jaw and being lost or separated therefrom. Alternatively, the projecting member can be rotated to extend into the axial passage for applying a localized clamping force to a small diameter electrical cord.

Figure 5:
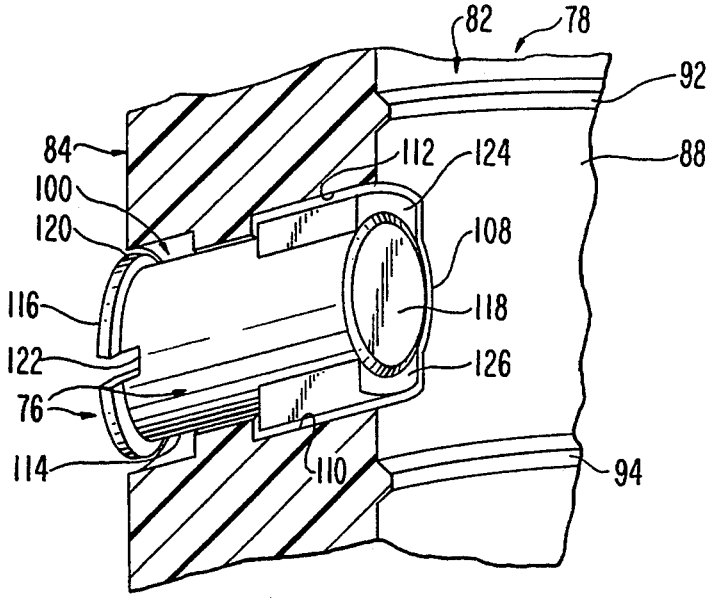
FIG. 5 is a cross-sectional perspective view of a third embodiment of the invention showing an electrical connector including a clamping jaw having a bayonet-type projecting member having a pair of keys received in recesses in a wall in a radial bore of the jaw.
Figure 6:
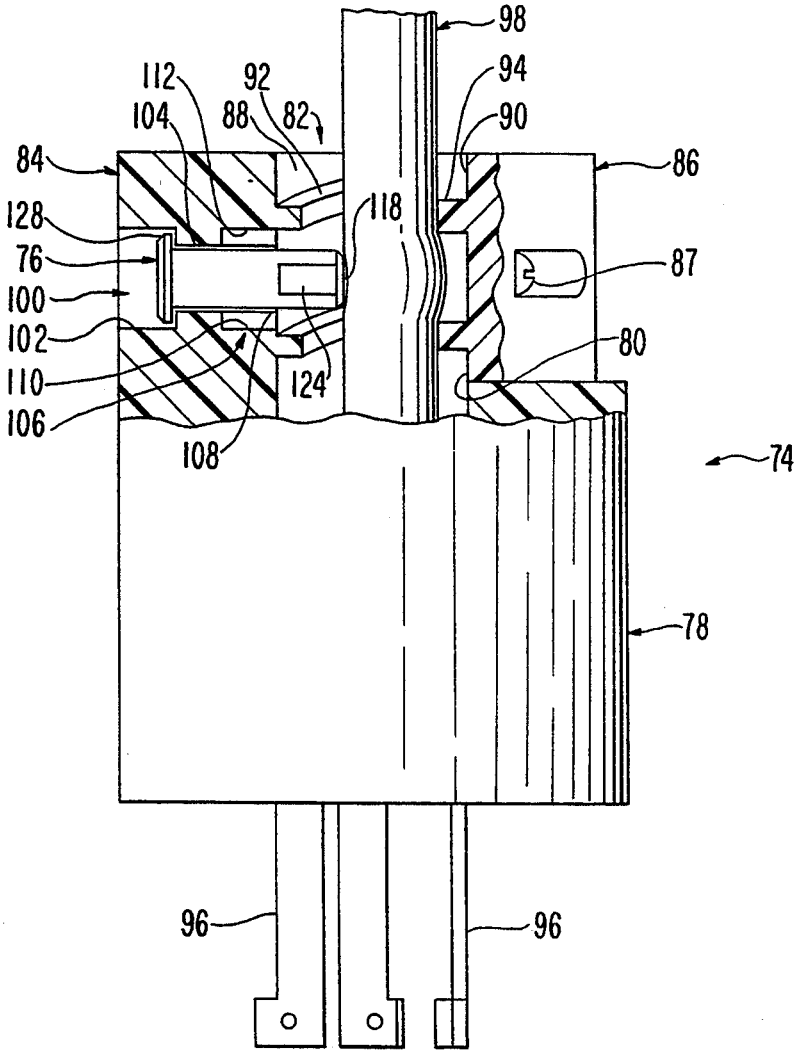
FIG. 6 is a side elevational view in partial cross section of the embodiment of FIG. 5 showing the projecting member in the extended position to accommodate a small diameter electrical cord.

Embodiment of FIGS. 5 and 6

As seen in FIGS. 5 and 6, a modified embodiment of the invention is shown comprising an electrical connector 74. This modified connector is constructed in a manner similar to the embodiment shown in FIGS. 1–3 except that the projecting member 76 has a bayonet-type movement. The electrical connector 74 comprises a main body 78 having an inner wall 80 defining an axial passage 82. A fixed clamping Jaw 84 is integrally formed with the main body and extends axially therefrom along the axial passage as shown in FIG. 6. A movable clamping jaw 86 is interconnected to the fixed clamping jaw 84 by a pair of screws 87 for applying clamping forces to the fixed clamping jaw. The fixed clamping jaw 84 and the movable clamping jaw 86 each include a contoured inner wall 88 and 90, respectively, in the axial passage 82. The inner contoured wall 88 of the fixed clamping jaw 84 includes a pair of raised gripping ribs 92 disposed in a spiral fashion with respect to the axial passage. The inner contoured wall 90 of the movable clamping jaw 86 also includes a pair of raised gripping ribs 94 disposed in a spiral fashion with respect to the axial passage and arranged to criss-cross with the gripping ribs 92 of the fixed clamping jaw 84. In alternative embodiments, the raised gripping ribs are orthogonal with respect to the axial passage. A plurality of contact blades 96 extend from an axial face of the connector opposite the clamping jaws. The blades 96 are connected to the electrical cord 98 in conventional fashion.

The fixed clamping jaw 84 has a radial bore 100 extending therethrough from the outer wall to the axial passage 82. The radial bore 100 has a first outer cylindrical portion 102 adjacent the outer wall of the fixed clamping jaw 84 and a middle portion 104 forming an inwardly extending annular rib. As shown in FIG. 6, the annular rib 104 is positioned between the outer wall 84 and the contoured inner wall 90 of the fixed clamping jaw. An inner portion 106 of the bore 100 facing the axial passage includes a substantially cylindrical wall 108 having a pair of diametrically opposed recesses 110 and 112. The cylindrical wall 108 of the bore is essentially a continuation of the annular rib 104 defining the middle portion of the bore. In the embodiment of FIGS. 5 and 6, the recesses 110 and 112 are positioned along the center axis of the main body as shown in FIG. 6.

The projecting member 76 comprises a substantially elongated cylindrical body 114 having an outer axial face 116 and an inner axial face 118. An annular collar 120 extends outwardly from the cylindrical body 114 proximate to the outer axial face 116. A recess 122 is provided in the axial face 116 to receive a rotary tool, such as a screwdriver. A pair of key members 124 and 126 are diametrically opposed and extend radially outward from the cylindrical body 114 adjacent the inner axial face 118 of the projection member.

In assembling the electrical connector 74, the projecting member 76 is inserted into the radial bore 100. The projecting member in preferred embodiments is formed from an insulating plastic material which is sufficiently flexible such that the annular collar can slide through the radial bore 100 from the inner contoured wall 88 and snap over the annular rib 104. To facilitate assembly of the projecting member 76 in the bore 100, the annular collar 120 includes a chamfered edge 128. In the assembled position, the keys 124 and 126 of the projecting member 76 are received in the recesses 110 and 112 adjacent the contoured inner wall 88 of the fixed clamping jaw 84. As shown in FIGS. 5 and 6, the annular rib 104 positioned in the middle portion of the bore 100 defines a stop member to limit the longitudinal movement of the projecting member 76 within the bore 100. In the first retracted position as shown in FIG. 5, the keys 124 and 126 are received in the recesses 110 and 112 with the keys engaging the annular rib 104 to prevent the projecting member from being removed from the clamping jaw. In this position, the outer axial face 116 of the projecting member 76 is substantially flush with the contoured inner wall 88 of the fixed clamping jaw 84.

An electrical cord having a standard size outer diameter can then be inserted to the axial passage and the screws interconnecting the movable jaw to the fixed jaw tightened. With the projecting member in the retracted position, the gripping ribs 92 and the gripping ribs 94 of the movable clamping Jaw engage the outer surface of a standard size electrical cord in a manner substantially the same as that described above in reference to the embodiment of FIG. 1.

The electrical connector 74 is further adapted to accommodate an electrical cord having a diameter less than a standard size electrical cord which would not otherwise be securely clamped between the clamping Jaws due to the limited radial movement of the movable clamping jaw. In operation, the movable clamping jaw 86 is moved away from the axial passage and the fixed clamping jaw 84 by adjustment of the screws. The small diameter electrical cord 98 is then positioned within the axial passage and the appropriate electrical connections are made to the blades 96. A rotary tool, such as, for example, a screwdriver, is inserted into the recess 122 in the outer axial face 116 of the projecting member to apply an axial force to the projecting member to cause the projecting member to slide within the bore until the annular collar 120 engages the annular rib 104. A rotational movement is then applied to the projecting member to rotate the projecting member 90° so that the keys 124 and 126 are no longer aligned with the recesses 110 and 112 substantially as illustrated in FIG. 6, and their rear edges engage wall 88.

The screws interconnecting the movable clamping jaw to the fixed clamping jaw are then adjusted to apply a clamping force to the electrical cord between the axial face 116 of the projecting member and the gripping ribs 94 of the movable jaw 86. The clamping force is applied so that the axial face 116 and the gripping ribs 94 form an impression in the outer surface of the electrical cord to securely grip the cord and prevent axial movement of the electrical cord within the axial passage. The small diameter electrical cord can be replaced with a standard size electrical cord by reversing the order of the steps and retracting the projecting member 76 into the fixed clamping jaw.

Figure 7:
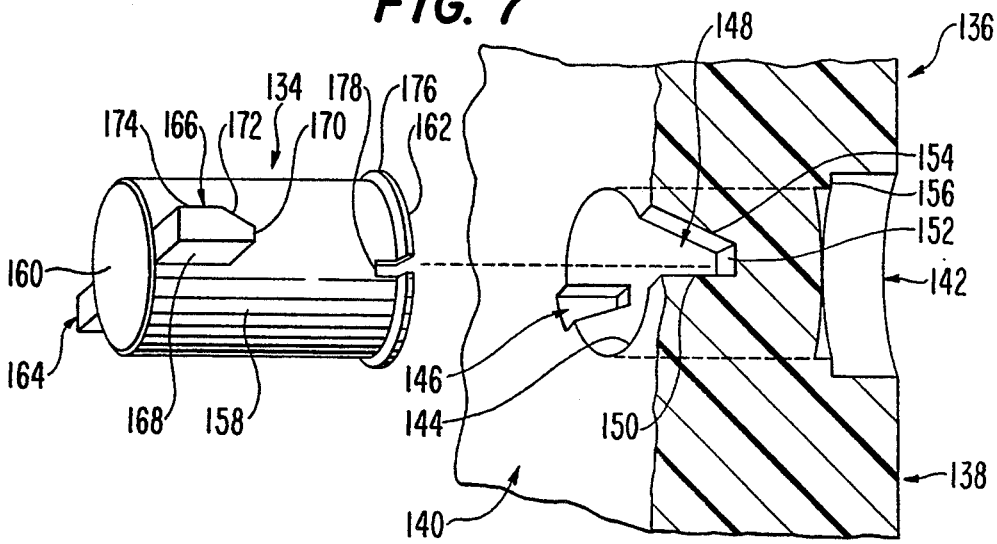
FIG. 7 is an exploded view of a fourth embodiment of the invention showing a partial cross-section of a movable jaw of an electrical connector including a bayonet-type projecting member having a pair of keys extending from the body of the projecting member and having inclined cam faces.
Figure 8:
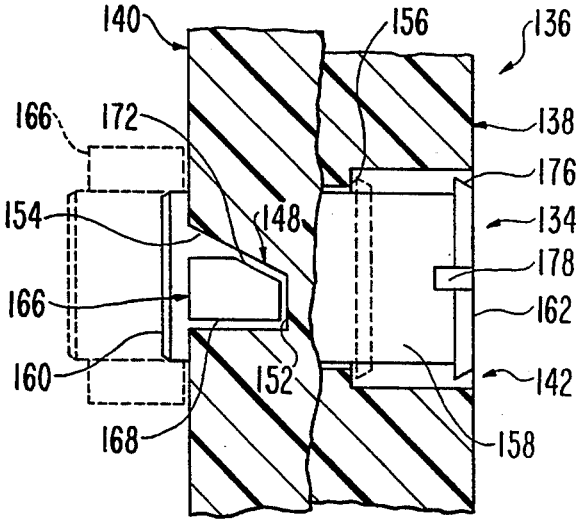
FIG. 8 is a cross-sectional side view of the embodiment of FIG. 7 showing the projecting member seated in the recess of the body of the connector with the keys engaging the cam surfaces in the recess.
Figure 9:
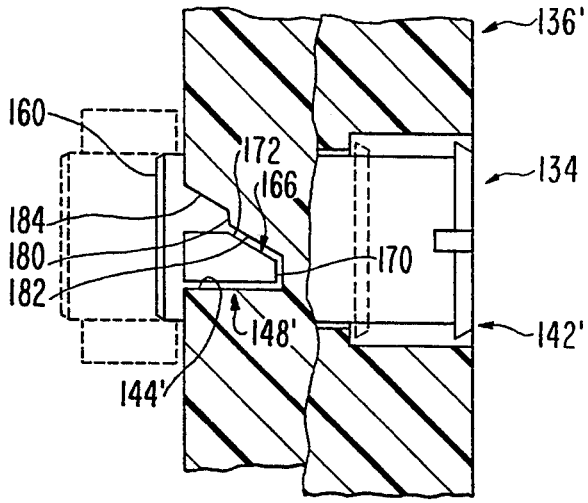
FIG. 9 is a cross-sectional view of a further embodiment of the invention showing an electrical connector and a stepped cam surface in the wall of the recess of the connector body to cam a projecting member outward.

Embodiment of FIGS. 7–9

As illustrated in FIGS. 7–9, a further embodiment of the electrical connector is shown. In this embodiment, the electrical connector is constructed in a fashion similar to that shown in FIGS. 1–3 except that the projecting member 134 is coupled to the movable clamping jaw 136. FIGS. 7 and 8 show a partial cross section of the projecting member and the bore in the movable jaw. FIG. 9 is a cross-sectional view of a slightly modified embodiment showing the projecting member and the bore in the movable clamping jaw. The electrical connector in this embodiment comprises a main body having an axial passage for receiving an electrical cord, a fixed clamping jaw and a movable clamping jaw interconnected to the first clamping jaw by screws to apply clamping forces to the electrical cord positioned between the clamping jaws in a manner substantially the same as in FIG. 1 and thus, these components are not specifically illustrated in FIGS. 7–9.

The movable clamping jaw 136 comprises an outer wall 138 and a contoured inner wall 140. A radial bore 142 having a substantially cylindrical wall 144 extends through the movable jaw. A pair of recesses 146 and 148 are provided in the cylindrical wall 144 adjacent the contoured inner wall 140. Each recess 146, 148 includes a first side substantially parallel to the axis of the bore 142 terminating at a bottom side wall 152 extending substantially perpendicular to the axis of the bore. A second side 154 of the recess extends from the contoured inner wall 140 to the bottom wall 152 of the recess and is arranged at an angle with respect to the axis of the bore to define a camming surface. The bore 142 further includes a step portion 156 adjacent the outer wall 138 to define a substantially circular area having a diameter slightly greater than the diameter of the bore 142.

The projecting member 134 comprises a substantially cylindrical body 158 having an inner axial face 160 and an outer axial face 162. A pair of diametrically opposed keys 164 and 166 extend radially from the cylindrical body 158 proximate to the inner axial face 160. Each key 164, 166 comprises a first side 168 extending substantially parallel to the axis of the projecting member, a second end side 170 perpendicular to the first side and a third side 172 opposite the first side and disposed at an angle with respect to the axis of the projecting member. A fourth side 174 extends from the angled side 172 to the axial face 160 and is substantially parallel to the first side 168. The angled side 172 defines a camming surface complementing the camming surface 154 of the recess in the bore. An annular collar 176 extends radially outward from the cylindrical body 158 proximate the outer axial face 162. A recess 178 is provided in the axial face 162 for receiving a rotary tool, such as, for example, a screwdriver.

In assembling the connector in accordance with this embodiment of the invention, the projecting member 134 is positioned within the bore 142 by sliding the annular collar 176 through the bore from the contoured inner wall 140 so that the annular collar snaps into the stepped portion 156 as shown in FIG. 8. The stepped portion 156 thus serves as a stop member cooperating with the annular collar 176 to limit the longitudinal movement of the projecting member inwardly toward the axial passage. The keys 164 and 166 are received in the recesses 146 and 148, respectively, as shown in FIG. 8 to limit the longitudinal movement of the projecting member in the bore and to prevent the projecting member from being separated from the movable clamping jaw 136.

The projecting member 134 has a normal first retracted position as illustrated in FIG. 8 where the keys 164 and 166 extending from the cylindrical body of the projecting member are seated in the recesses 146 and 148 in the side wall of the bore 142. In this embodiment, the inner axial face 160 is shown projecting slightly from the contoured inner wall 140 of the movable clamping jaw 136. In this position, the electrical connector is able to clamp a standard size electrical cord between the clamping jaws as in the embodiments previously described.

When it is desirable to clamp a small size electrical cord within the axial passage of the connector, the projecting member is adjusted to the extended position shown by phantom lines in FIG. 8. To adjust the projecting member to the extended position, a rotary tool, such as a screwdriver, is inserted into the recess 178 in the outer axial face 162 to apply rotary and translational forces to the projecting member with respect to the movable jaw 136. The angled side 172 of the key forms a camming surface with the inclined wall 154 of the recess whereby rotation of the projecting member causes axial movement of the projecting member to the position shown in phantom lines in FIG. 8. In the extended position, the keys 164 and 166 rest on the contoured inner wall 140 of the movable jaw 136 and the annular collar 176 contacts the stepped portion 156 to prevent the projecting member from being separated from the movable jaw. The electrical cord is then inserted into the connector through the axial passage as in the previous embodiments. Clamping forces are applied to the movable jaw to clamp the electrical cord between the fixed clamping jaw and the inner axial face 160 of the projecting member 134 to prevent axial movement of the electrical cord within the connector.

In the slightly modified embodiment illustrated in FIG. 9, the recess 148' in the side wall 144' of the bore 142' includes a step portion 180. The step portion 180 is positioned approximately at the midpoint of the inclined wall of the recess to define two separate inclined camming surfaces 182 and 184. The assembly and operation of this embodiment is identical to the operation of the embodiment of FIGS. 7 and 8. The projecting member 134 is recessed in the bore with the keys 164 and 166 being received in the recesses in the side wall of the bore so that the connector can accommodate a standard size electrical cord. The projecting member is moved to the extended position by applying a rotary force to the projecting member so that the camming surfaces on the keys engage the lower camming surfaces 182 in the recesses to cause axial movement of the projecting member outward from the contoured face of the clamping jaw. The projecting member may be positioned at an intermediate position such that the bottom side 170 of the key is resting on the step portion 180 in the wall of the recess. Applying further rotation to the projecting member causes the camming surface 172 of the key to engage the outer camming surface 184 to cam the projecting member to a fully extended position as shown by phantom lines in FIG. 9. The projecting member can be retracted by rotating the projecting member in the opposite direction and applying an axial force to the inner axial face 160 of the projecting member to recess the keys into the recesses in the side wall of the bore.

Figure 10:
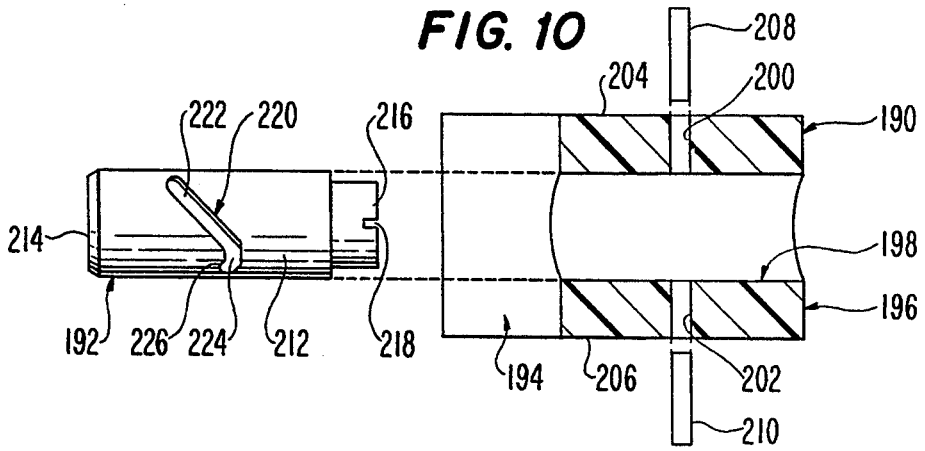
FIG. 10 is an exploded view of still another embodiment of the invention showing an electrical connector including a projecting member in a movable jaw and retained therein by a pair of pins extending through the jaw.

Embodiment of FIG. 10

As seen in FIG. 10, a further embodiment of the invention is shown comprising an electrical connector including a movable clamping jaw 190 and a projecting member 192. The electrical connector is substantially the same as in FIG. 1 with the exception that the projecting member 192 is coupled to the movable jaw. The electrical connector comprises a main body having an axial passage and a fixed clamping jaw cooperatively coupled to the movable jaw 190. Since the electrical connector is otherwise the same as the embodiment of FIG. 1, only the movable jaw is illustrated in FIG. 10.

The movable clamping jaw 190 includes an outer wall 196 and a contoured inner wall 194 for facing the axial passage and the fixed clamping jaw. A radial bore 198 extends through the movable jaw 190 from the inner wall 194 to the outer wall 196. A pair of holes or passageways 200 and 202 extend transversely through the movable jaw from the top and bottom sides 204 and 206, respectively, to the bore 198. The holes 200 and 202 in the embodiment of FIG. 10, are diametrically opposed and extend radially to the bore 198. A pair of pins 208 and 210 are inserted into the holes 200 and 202 to extend a short distance into the bore 198. In the embodiment of FIG. 10, the pins 208 and 210 are friction-fitted into the holes 200 and 202. Alternatively, the holes 200 and 202 may have internal threads for receiving threaded pins.

The projecting member 192 has a substantially cylindrical body 212, an inner axial face 214 and an outer axial face 216. A recess 218 is provided in the outer axial face 216 for receiving a rotary tool. A pair of grooves 220 are provided on opposite sides of the cylindrical body 212 for mating with the pins 208 and 210. Each groove 220 comprises a straight first portion 222 inclined with respect to the central axis of the cylindrical body 212 defining a camming surface and an arcuate portion 224 positioned toward the outer axial end 216 of the projecting member. In the embodiment of FIG. 10, an optional recessed area 226 is provided in the end of the arcuate portion 224 to provide a positive locking feature for the projecting member when the cord clamping force is applied to projecting member 192.

In assembling the connector in this embodiment, the projecting member 192 is inserted into the bore 198 within the movable jaw 190. The pins 208 and 210 are then inserted through the holes 200 and 202 and their ends are received in the grooves 220 in the cylindrical body of the projecting member. The inclined portion 222 of the groove 220 functions as a camming surface cooperating with the pins. Rotational movement applied to the projecting member cams the projecting member outward from the contoured inner wall of the movable jaw 190. The projecting member 192 is rotated to cam the projecting member outward to the fully extended position so that the pins 208 and 210 are received in the arcuate portion 224 and the recess portion 226 of the groove in the cylindrical body of the projecting member.

The movable jaw 190 is interconnected to the fixed jaw of the electrical connector in a fashion similar to FIG. 1 to apply clamping forces to an electrical cord between the jaws. A small size electrical cord can be clamped by rotating the projecting member to the fully extended position and applying clamping forces to the movable jaw to clamp the electrical connector between the fixed jaw and the inner axial face 214 of the projecting member 192. The projecting member 192 can be retracted by rotation in the reverse direction to cam the projecting member inwardly to a recessed position within the movable clamping jaw 190. In this embodiment, the pins 208 and 210 function as a camming surface to cam the projecting member inwardly and outwardly from the movable jaw and to limit axial movement of the projecting member within the bore.

Figure 11:
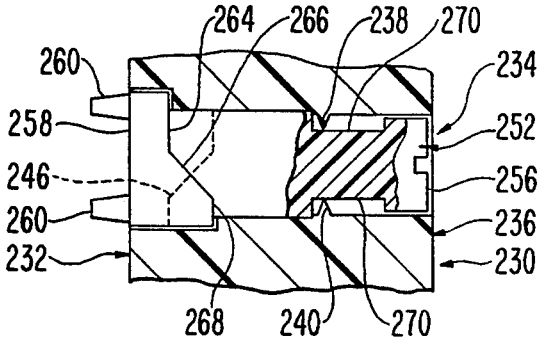
FIG. 11 is a cross-sectional view of a further embodiment of the invention showing an electrical connector including a first cam surface on a projecting member for camming the projecting member outward by rotation of the projecting member and a second camming surface for retracting the projecting member.
Figure 12:
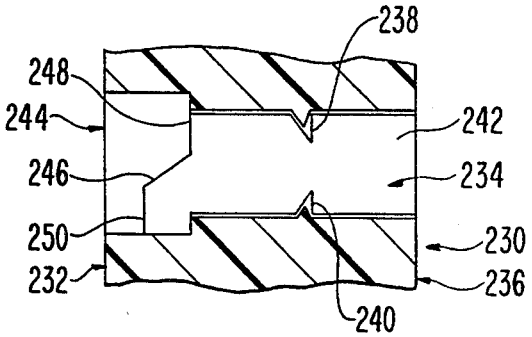
FIG. 12 is a cross-sectional view of the bore in the movable jaw of the embodiment of FIG. 11 showing the cam surfaces in the bore.
Figure 13:
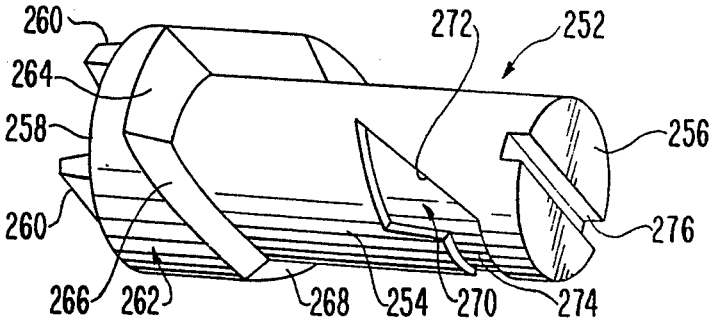
FIG. 13 is an enlarged perspective view of the projecting member of the embodiment of FIG. 12 showing the two cam surfaces.

Embodiment of FIGS. 11–13

As seen in FIGS. 11–13, a modified embodiment of the projecting member of the invention is shown for use with an electrical connector having an axial passage for receiving an electrical cord, a fixed clamping jaw and a movable clamping jaw. The structure of the electrical connector is substantially the same as in the previous embodiments and thus FIG. 11 illustrates only a partial cross-sectional view of the projecting member of the invention. In this embodiment of the invention, the movable clamping jaw 230 comprises an inner contoured wall 232 for applying clamping forces to an electrical cord between the fixed clamping jaw and the movable clamping jaw. The fixed jaw and the movable jaw are interconnected by screws to bias the jaws toward each other and apply the clamping forces to the cord. The movable clamping jaw 230 includes a radial bore 234 extending from the contoured inner wall to the outer wall 236. A pair of diametrically opposed detents 238 and 240 extend inwardly from the side wall 242 of the bore 234. In preferred embodiments, the detents 238, 240 have a perpendicular side facing the outer wall 236 and an inclined wall facing the inner wall 232. An annular recessed area 244 is provided in the side wall of the bore 234 adjacent the contoured inner wall 232. The recessed area 244 and inclined wall 246 define a camming surface as shown in FIG. 12. FIG. 12 illustrates a cross-sectional view of the bore 234 and thus it is to be understood that an identical inclined wall is provided on the opposing side of the side wall of the bore. The recessed area 244 also includes a lower ledge portion 248 and an upper ledge portion 250 as shown in FIG. 12.

The projecting member 252 as seen in FIG. 13 comprises a substantially cylindrical body portion 254 having an outer axial face 256 and an inner axial face 258. A pair of teeth 260 extend axially from the inner axial face 258 for gripping the electrical cord as discussed hereinafter in greater detail. A collar 262 is provided adjacent the inner axial face 258 and comprises a first wall 264 extending substantially perpendicular to the central axis of the projecting member, an inclined wall 266 being angled with respect to the axis and a second arcuate wall 268 which is substantially perpendicular to the central axis of the projecting member. The dimensions of the annular collar 262 complement the recessed portion 244 in the bore such that the respective inclined walls of the projecting member and the recess 244 define camming surfaces such that upon rotation of the projecting member with respect to the movable jaw, the projecting member is cammed outwardly from the contoured inner wall 232.

The cylindrical body portion 254 further includes a pair of recesses 270 as shown in FIG. 13. Each recess 270 has a substantially triangular shape defining a camming surface 272 which is inclined with respect to the central axis of the projecting member. A leg portion 274 extends arcuately along the cylindrical body from the recess 270 next to the outer axial face 256. A recess 276 is provided in the outer axial face 258 for receiving a rotary tool such as a screwdriver.

In the assembly and operation of this embodiment, the projecting member 252 is inserted into the bore 234 by inserting the outer axial face 256 of the projecting member into the bore from the side of the contoured inner wall 232. The projecting member 252 and the clamping jaw are preferably produced from a resilient plastic material such that the projecting member is able to slide over the detents 238 and 240. The detents 238 and 240 snap into position in the two recesses 270 as shown in FIG. 11. The annular collar 262 on the projecting member is nested within the recess 244 of the bore 234 for clamping a standard size electrical cord between the fixed clamping jaw and the movable clamping jaw in a fashion similar to the embodiment of FIG. 1. A small size electrical cord can be clamped by inserting a rotary tool into the recess 276 of the outer face 256 and rotating the projecting member with respect to the clamping jaw in a clockwise direction as seen from the right side of FIG. 11. Rotation of the projecting member causes the camming surfaces 246 in the bore and the camming surface 266 on the projecting member to cam the projecting member outwardly to extend from the contoured inner wall 232. In the extended position, the arcuate wall 268 of the annular collar 262 sits on the upper ledge 250 of the recess in the bore. The triangular recesses 270 cooperate with the detents 238 and 240 to limit axial movement of the projecting member within the bore. In the fully extended position, the detents 238 and 240 are received in the leg portions 274 of the recesses 270.

The projecting member can be retracted into the jaw by rotating in the reverse direction so that the detents 238 and 240 contact the camming walls 272 of the recesses 270. As can be seen, rotation of the projecting member cams the projecting member into the clamping jaw. This embodiment of the invention thus provides a dual camming system where a first cam surface moves the projecting member to an extended position and a second camming surface moves the projecting member to the retracted position. In the extended position, the movable clamping jaw is urged toward the fixed clamping jaw such that clamping forces are applied to an electrical cord between the fixed clamping jaw and the teeth 260 on the axial face of the extended projection member. In preferred embodiments, the teeth 260 are arranged on the axial face 258 such that when the projecting member is in the extended position, the teeth are substantially perpendicular to the central axis of the electrical conductor being clamped.

While advantageous embodiments have been chosen to illustrate the invention, it will be understood by those skilled in the art that various changes and modifications can be made therein without departing from the scope of the invention as defined in the appended claims.

What is claimed is:

1. An electrical cord clamp comprising:

a main body having a outer wall and an inner wall, said inner wall defining an axial passage for receiving an electrical cord;

means on said inner wall defining a first clamping jaw;

a second clamping jaw opposing said first clamping jaw and being movable perpendicular to said axial passage;

connecting means for interconnecting said first and second clamping jaws and for applying clamping forces to an electrical cord in said axial passage;

said first clamping jaw having a radial bore therethrough extending radially with respect to said axial passage; and projecting means, disposed in said radial bore and being axially movable therein from a first position to a second position projecting radially inward from said inner wall into said axial passage for engaging said electrical cord and biasing said electrical cord against said second clamping jaw, said first and second clamping jaws engaging a large diameter cord when said projecting means is in said first position and said projecting means and said second clamping jaw engaging a smaller diameter cord when said projecting means is in said second position.

2. The clamp of claim 1, and further comprising a plurality of electrical prongs extending axially from said main body for connecting to said electrical cord.

3. The clamp of claim 1, wherein said connecting means comprises a plurality of screws extending through said second clamping jaw to said first clamping jaw.

4. The clamp of claim 1, and further comprising internal threads extending along an inner surface of said bore, said projecting means having external threads complementing said threads in said bore.

5. The clamp of claim 4, wherein said projecting means further comprises means for rotating said projecting means.

6. The clamp of claim 5, wherein said rotating means comprises a recess in an axial end thereof for receiving a rotary tool.

7. The clamp of claim 1, wherein said radial bore further comprises first stop means to limit axial movement of said projecting means within said bore.

8. The clamp of claim 7, wherein said first stop means is disposed in said bore for cooperating with second stop means on said projecting means.

9. The clamp of claim 8, wherein said second stop means on said projecting means comprises an axial face thereof.

10. The clamp of claim 9, wherein said axial face of said projecting means faces radially outward from said axial passage, and said first stop means in said radial bore comprises an inwardly extending annular rib proximate said outer wall.

11. The clamp of claim 7, wherein said projecting means has an annular collar proximate an axial face thereof and extending radially outward from said projecting means, and said first stop means in said radial bore is disposed between said inner and outer walls of said main body for engaging said annular collar to limit axial movement of said projecting means.

12. The clamp of claim 7, wherein said first stop means comprises a pin extending through a transverse bore in a side wall of said radial bore and projecting radially inward into said radial bore.

13. The clamp of claim 7, wherein said first stop means comprises a pair of diametrically opposing pins extending radially inward in said radial bore, and said projecting means includes a pair of grooves for receiving said pins.

14. The clamp of claim 1, wherein said projecting means further comprises means, cooperating with said radial bore, for defining said first and second position of said projecting means in said radial bore.

15. The clamp of claim 14, wherein said means cooperating with said bore comprises a pair of diametrically opposed keys extending radially outward from said projecting means.

16. The clamp of claim 15, wherein said bore includes a pair of recesses in a side wall of said bore for receiving said keys when said projecting means is in said first position.

17. The clamp of claim 16, wherein each of said recesses has a wall inclined with respect to a longitudinal axis of said bore to define first camming means, and each of said keys has second camming means for cooperating with said first camming means.

18. The clamp of claim 17, wherein said second camming means comprises a side wall of said key which is inclined with respect to said longitudinal axis of said projecting means.

19. The clamp of claim 16, wherein each of said recesses in said bore has a side wall, each of said side walls having a first portion inclined with respect to a longitudinal axis of said bore, a second portion perpendicular to said longitudinal axis, and a third portion inclined with respect to said longitudinal axis of said bore to define a stepped camming surface.

20. The clamp of claim 16, wherein said keys are positioned at a first axial end of said projecting means for extending into said axial passage, and said projecting means includes stop means on a second axial end for cooperating with said bore to limit axial movement of said projecting means.

21. An electrical connector having a main body with an inner wall to define an axial passage for receiving an electrical cord, a plurality of electrical contacts and clamping means for clamping said electrical cord in said axial passage, said clamping means comprising:

a first clamping jaw on said inner wall having a clamping face in said axial passage;

a second clamping jaw movable relative to said first clamping jaw and having a clamping face opposing said first clamping jaw;

connecting means for interconnecting said first and second jaws and for applying clamping forces to an electrical cord in said axial passage; and projecting means rectilinearly movable along and rotatably movable about an axis radially disposed to said axial passage, said projecting means being movable from a first position to a second position projecting into said axial passage for selectively adjusting the cross-sectional dimension of said axial passage and clamping said electrical cord against one of said jaws, said first and second clamping jaws engaging a large diameter cord when said projecting means is in said first position and said projecting means and one of said first or second clamping jaws engaging a smaller diameter cord when said projecting means is in said second position.

22. The connector of claim 21, wherein said projecting means is coupled to said first clamping jaw.

23. The connector of claim 21, wherein said projecting means is coupled to said second clamping jaw.

24. The connector of claim 21, and further comprising means defining a bore extending radially with respect to said axial passage, said projecting means being disposed in said bore and being movable along a longitudinal axis of said bore from said first position to said second position.

25. The connector of claim 24, and further comprising first stop means extending radially into said bore to limit longitudinal movement of said projecting means.

26. The connector of claim 25, wherein said first stop means comprises a pair of diametrically opposed pins extending into said bore.

27. The connector of claim 26, wherein said second clamping jaw has a pair of diametrically opposed passageways extending radially from said bore, said pins being disposed in said passageways.

28. The connector of claim 26, wherein
said projecting means has a pair of grooves for receiving said pins for limiting linear movement of said projecting means in said bore.

29. The connector of claim 28, wherein
each of said grooves comprises
a first portion angled with respect to the longitudinal axis of said projecting means to define a camming surface, whereby rotation of said projecting means with respect to said pins moves said projecting means along said longitudinal axis.

30. The connector of claim 29, wherein each of said grooves further comprises
a second portion contiguous with an end of said first portion and extending arcuately with respect to said longitudinal axis for receiving said pins when said projecting means is in said second position.

31. The connector of claim 30, wherein each of said grooves further comprises
a third portion contiguous with an end of said second portion and extending longitudinally with respect to said projecting means.

32. The connector of claim 24, wherein said projecting means further comprises
means, cooperating with said bore, for defining said first and second position of said projecting means in said bore.

33. The connector of claim 32, wherein said means cooperating with said bore comprises
a pair of diametrically opposed keys extending radially outward from said projecting means.

34. The connector of claim 33, wherein said bore further comprises
a pair of recesses in a side wall of said bore for receiving said keys when said projecting means is in said first position, said recesses being open to said bore and to said axial passage.

35. The connector of claim 34, wherein
each of said recesses has side walls inclined with respect to the longitudinal axis of said bore to define first camming means,
each said keys having second camming means for cooperating with said first camming means.

36. The connector of claim 35, wherein said second camming means comprises
a side wall of said key which is inclined with respect to said longitudinal axis of said projecting means.

37. The connector of claim 34, wherein
each of said recesses in said bore has a side wall, each of said side walls having a first portion inclined with respect to a longitudinal axis of said bore, a second portion perpendicular to said longitudinal axis, and a third portion inclined with respect to said longitudinal axis of said bore.

38. The connector of claim 34, wherein
said keys are positioned at a first axial end of said projecting member for extending into said passage, and
said projecting means comprises stop means on a second axial end for cooperating with said bore to limit longitudinal movement of said projecting means.

39. The connector of claim 38, wherein said stop means comprises
an annular collar extending radially outward from said projecting means.

40. The connector of claim 24, wherein
said projecting means has threads on an outer surface thereof, and
said bore has internal threads for accommodating said threads on said projecting means.

41. The connector of claim 24, wherein said projecting means further comprises
gripping means for gripping said electrical cord, said gripping means being located on an axial face of said projecting means facing said axial passage.

42. The connector of claim 41, wherein said gripping means comprises
at least one rib extending transversely across said axial face, and positioned such that said rib is substantially transverse to said axial passage when said projecting means is in said second position.

43. The connector of claim 24, wherein
said projecting means has first and second camming means;
said bore including third camming means, cooperating with said first camming means, for camming said projecting means into said axial passage upon rotation of said projecting means in a first direction, and fourth camming means, cooperating with said second camming means, for camming said projecting means outwardly from said axial passage upon rotation of said projecting means in a second direction.

44. The connector of claim 43, wherein
said first camming means comprises a collar extending radially outward from said projecting means and having a cam surface inclined with respect to an axis of said projecting means, and
said third camming means comprises a recess in a wall of said bore.

45. The connector of claim 43, wherein
said second camming means comprises a recess in said projecting means, said recess having a cam surface inclined with respect to an axis of said projecting means, and
said fourth camming means comprises a detent extending from a wall of said bore and being received in said recess.

* * * * *